US006797031B1

(12) United States Patent
Engström

(10) Patent No.: US 6,797,031 B1
(45) Date of Patent: Sep. 28, 2004

(54) WIRE-SHAPED PRODUCT, METHOD FOR ITS MANUFACTURING, AND WEAR PART MADE OF THE PRODUCT

(75) Inventor: Claes-Henrik Engström, Örebro (SE)

(73) Assignee: Haldex Garphyttan Aktiebolag, Garphyttan (SE)

( * ) Notice: Subject to any disclaimer, the term of this patent is extended or adjusted under 35 U.S.C. 154(b) by 21 days.

(21) Appl. No.: 10/110,971

(22) PCT Filed: Oct. 11, 2000

(86) PCT No.: PCT/EP00/10021

§ 371 (c)(1),
(2), (4) Date: Apr. 18, 2002

(87) PCT Pub. No.: WO01/29274

PCT Pub. Date: Apr. 26, 2001

(30) Foreign Application Priority Data

Oct. 18, 1999 (SE) ..... 9903732

(51) Int. Cl.[7] ..... C22C 38/22; C22C 38/24; C22C 38/26; C22C 38/28

(52) U.S. Cl. ..... 75/246; 75/236; 75/239; 148/325; 148/326

(58) Field of Search ..... 148/325, 326; 75/236, 239, 246

(56) References Cited

U.S. PATENT DOCUMENTS 2,888,740 A 6/1959 Danis
4,985,092 A * 1/1991 Kaede et al. ..... 148/326

FOREIGN PATENT DOCUMENTS

DE 42 00 489 A1 7/1992

OTHER PUBLICATIONS

Patent Abstracts of Japan, Pub. No. 02080540 Ishikura, "Wire for Dot Printer" (1990).
Patent Abstracts of Japan, Pub. No. 04323349 Kawamura, "High Carbon Stainless Wire Rod Having . . . " (1992).
Patent Abstracts of Japan, Pub. No. o8218148 Nakamura, "Steel Wire for Piston Ring and . . . " (1996).

* cited by examiner

*Primary Examiner*—Deborah Yee
(74) *Attorney, Agent, or Firm*—Nixon & Vanderhye

(57) ABSTRACT

The invention concerns a method for the manufacturing of a wire-shaped product with high wear resistance. The characteristic feature is that a melt is prepared of a martensitic stainless chromium steel which contains in weight-% 0.6–3.0 C, max 2.0 Si max 2.0 Mn, 13–30 Cr, 0–10 Mo, from zero to totally max 10% of those strong carbide forming elements which belong to the group of elements which comprises V, Nb, Ta and Zr, totally max 1% of other, optionally existing alloying elements, balance iron and unavoidable impurities, that the melt is tapped and caused to solidify through cooling at a cooling rate of at least 100° C./s so that a solidified material is obtained which contains evenly distributed carbides, wherein essentially all existing carbide particles has a maximal particle size of 8 $\mu$m, particle size being defined as the mean value of the length and breadth of a particle observable in a light-optical microscope, and that an intermediate product is formed of said material in the form of a wire which is cold drawn and optionally is cold-rolled to desired final dimension, whereafter the wire is hardened and tempered for the achievement of said wire-shaped product which has a microstructure substantially consisting of tempered martensite containing carbides with a particle size of max 8 $\mu$m. The invention also concerns the wire-shaped product and its use for wear parts in combustion engines.

3 Claims, 1 Drawing Sheet

WIRE-SHAPED PRODUCT, METHOD FOR ITS MANUFACTURING, AND WEAR PART MADE OF THE PRODUCT

TECHNICAL FIELD

The invention concerns a wire shaped product with high wear resistance which product is cold drawn and subsequently flattened through cold-rolling, hardened and tempered, consisting of a martensitic stainless chromium steel. The invention also concerns a method relating to the manufacturing of such wire-shaped product, which can be employed for the manufacturing of wear parts in combustion engines, particularly compression rings and oil scraper rings for cylinder pistons. The invention also includes such wear parts, particularly compression rings.

BACKGROUND OF THE INVENTION

The most common material for compression rings in combustion engines is cast iron. A typical composition of such a cast iron contains 3.50–3.95% C, 2.20–3.10% Si and 0.40–0.80% Mn. Also compression rings of steel, including stainless martensitic chromium steels, are used to a considerable extent. A steel of that type which is employed for compression rings has the composition 0.70% C, 0.40% Si, 0.35% Mn, 14.0% Cr and 0.30% Mo, balance iron and impurities. A requirement which is raised on compression rings, particularly on the so called top ring, which is journalled in, a circumferential groove adjacent to the piston top, is that it shall have a high wear resistance which is maintained even after a long time of exposure to high tempers and corrosive media. In order to satisfy these requirements, also a stainless martensitic steel which consists of 0.90% C, 0.40 Si, 0.40 Mn, 18.0 Cr, 0.9 V, 1.0 Mo, balance iron and impurities, is used to a considerable extent. The wire-shaped product which has been cold drawn and cold-rolled to its final cross section, e.g. 1×3 mm, bright hardened and tempered by the material supplier, is spun by the compression ring manufacture to helical, so called "slinkies" in a slinky-machine. There is a problem that wires made of this high chromium, martensitic chromium steel easily rupture in connection with the spinning operation because of an insufficient ductility of the material. An other problem is that this wire-shaped product is expensive, which only to a small degree depends on the price of the alloy elements but basically on a very cumbersome manufacturing of the cold drawn and cold-rolled wire and, not least, on much rejected material because of failures during the manufacturing.

It is a purpose of the invention to address this complex of problems. More particularly, the invention aims at providing a wire-shaped product of the kind mentioned in the preamble, which has a good ductility and which therefore is suited to be spun in slinky-machines with a smaller risk for ruptures than what has previously been possible, and to be able to reproducibly manufacture from such a spun product, compression rings which have a high and even wear resistance and a good corrosion resistance.

It is also a purpose of the invention to simplify, and consequently to reduce the costs for the entire process in connection with the cold drawing of the wire, through a reduction of the number of steps in the process.

The improvements on which the invention is based can also be employed for the development of wire-shaped products of martensitic stainless steels, which have higher contents of included alloy elements than what previously has been possible with a good production economy within this technical field. Besides the above mentioned, martensitic chromium steels, thus a variety of steels having different chemical compositions are conceivable within the frame of the invention. Conceivable are for example steels which contain in weight-%: 1–2 C, 0–1.5 Si, 0–1 Mn, max 0.050 P, max 0.050 S, 22–27 Cr, 0.5–1.5 Mo, 0.5–1.0 V, balance essentially only iron and impurities. Within the said range, e.g. a steel can be conceived which has the nominal composition 1.2 C, 0.9 Si, 0.5 M, max 0.050 P, max 0.050 S, 22 Cr, 0.5 Mo, 0.5 V, balance essentially only iron and impurities. Another conceivable, nominal composition may be 1.7 C, 1.1 Si, 0.8 Mn, max 0.050 P, max 0.050 S, 27 Cr, 1.0 Mo, 0.7 V, balance essentially only iron and unavoidable impurities.

The above and other objectives of the invention can be achieved therein that the invention is characterized by what is stated in the accompanying patent claims. Further features and aspects of the invention will be apparent from the following, detailed description of the invention and from described examples and performed experiments.

BRIEF DESCRIPTION OF DRAWINGS

In the drawings,

FIG. 1A–1 show examples of cross sections of the wire-shaped product according to the invention.

DETAILED DESCRIPTION OF THE INVENTION AND OF PERFORMED STUDIES

Figure 1:
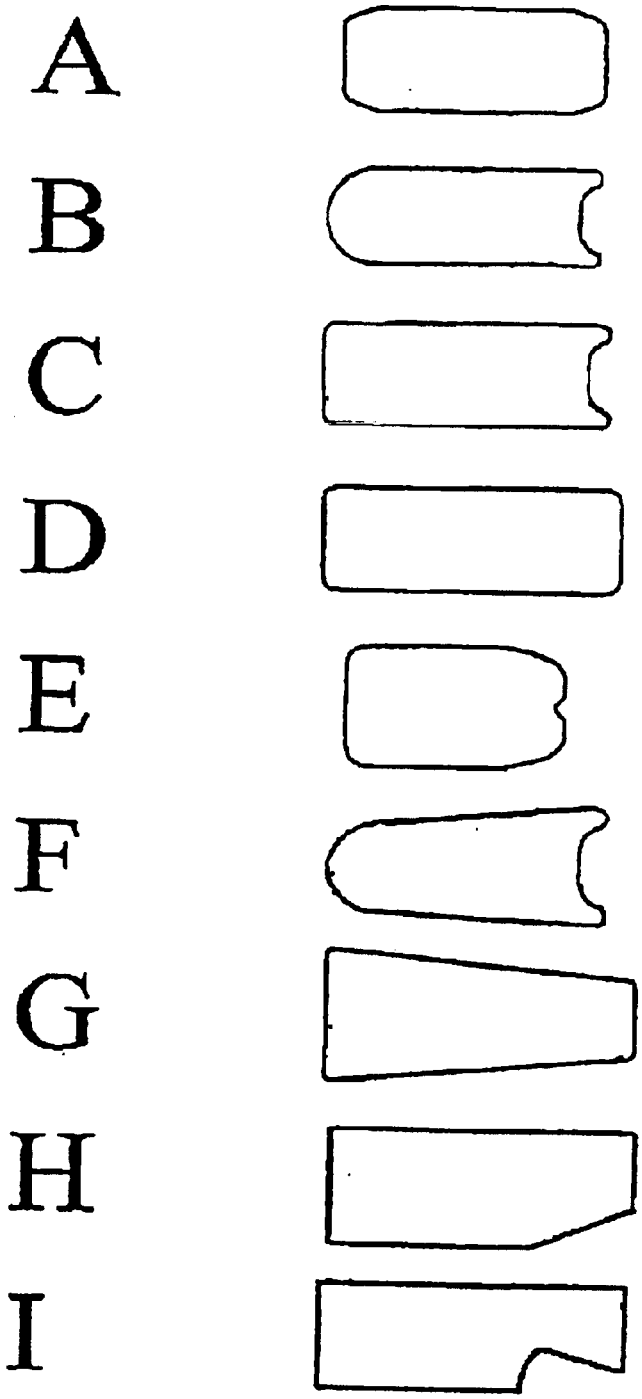

In the following there will be made a comparative study of conventional manufacturing and manufacturing according to the invention of a wire-shaped product for the manufacturing of compression rings of a steel which has the chemical composition which is known per se and which is mentioned in the preamble, namely 0.90% C, 0.40 Si, 0.40 Mn, 18.0 Cr, 0.10 V, 1.0 Mo, balance iron and unavoidable impurities. The studied materials contained max 0.040 P and max 0.030 S.

Conventionally, this known martensitic chromium steel is manufactured through the preparation, according to normal steel work practice of a steel melt having the said composition whereafter the melt is tapped and continuously cast, the strand being cooled as fast as possible through conventional technique, which means a cooling rate which normally is less than 1° C./s. The solidified strand is cut to form blooms or billets, which are hot-rolled, possibly after a preceding forging, to form blanks. From the blanks, a wire is manufactured through hot-rolling to—for example—size Ø5.5 mm.

The rolled wire then shall be cold drawn from e.g. size Ø5.5 mm to e.g. size Ø2.7 mm. which requires four cold drawing series, as far as the conventional material is concerned. Between each such series, the wire need to be subjected to intermediate annealing and pickling, and prior to each soft annealing the wire must be degreased. The schedule of operation is given in the left hand column in Table 1. The reason for the great number of drawing series was the limited ductility of the material which repeatedly required intermediate annealing operations, which in their turn required renewed pickling and degreasing prior to each intermediate annealing operation. The maximally possible size reduction before intermediate annealing was stated to be 39%; series 2 and 3. The most important reason for the bad ductility of the conventional material is judged to depend on the existence of large carbides in the material; see the carbide analyses below in this text.

The material which is used according to the described application of the invention has the same chemical composition as the described conventional material that has from its molten state been caused to solidify through cooling at a cooling rate of at least 100° C./s, preferably at least 1000° C./s, for the achievement of a solidified material, which contains evenly distributed carbides wherein essentially all existing carbide particles which are desirable per se in order that the product shall get a desired wear strength—have a maximal particle size of 8 μm particle size being defined as the mean value of the length and breadth of the particle which can be observed by means of a light-optical microscope. A carbide distribution and carbide size of that type can be achieved by causing the melt to solidify by gas atomisation of a stream of molten metal, i.e. disintigrating the molten metal by means of gas jets to form small droplets which are quickly caused to solidify through cooling at a rate of at least 100° C./s. Preferably the droplets are caused to solidify to form a powder by cooling the droplets at a rate of 1000–10000° C./s. From the thus obtained powder there is formed a consolidated body, which can be carried out in a mode which today is a conventional powder metallurgical technique, namely by being filled in capsules, which are sealed, whereafter the content is densified through operations which include hot isostatic pressing (HIP) for the formation of a completely dense body which is forged and hot-rolled to the shape of blanks, which in their turn are hot-rolled to form the hot-rolled wire which is the intermediate product which subsequently shall be cold drawn.

According to the application of the invention, which is described in this text, there was in other words used a powder metallurgically manufactured material which was hot-rolled to the shape of a wire of Ø5.5 mm. This wire then was cold drawn in the same production lines which are used for the conventional material. It was found that the powder metallurgically manufactured material could be drawn with as far as up to 65% area reduction before annealing. In order to reduce the thickness of the wire from Ø5.5 to Ø2.7 mm it was therefore required just one intermediate annealing, which can consist of a recrystallisation annealing or a soft annealing, as is shown in the right hand column in Table 1.

TABLE 1

Cold drawing - schedule of operations

| Drawing Series No.: | Conventional material | Drawing Series No.: | Material according to invention |
|---|---|---|---|
| 1 | Pickling<br>Drawing Ø 5.5 - Ø 4.6 mm<br>(reduction max 30%)<br>Degreasing<br>Intermediate annealing | 1 | Pickling<br>Drawing Ø 5.5 - Ø 3.25 mm<br>(reduction max 65%)<br>Degreasing<br>Intermediate annealing |
| 2 | Pickling<br>Drawing Ø 4.6 - Ø 3.6 mm<br>(reduction max 39%)<br>Degreasing<br>Intermediate annealing | 2 | Pickling<br>Drawing Ø 3.25 - Ø 2.7 mm<br>(reduction max 31%; max 65% reduction possible)<br>Degreasing<br>Annealing |
| 3 | Pickling<br>Drawing Ø 3.6 - Ø 2.81 mm<br>(reduction max 39%)<br>Degreasing<br>Intermediate annealing | | |
| 4 | Pickling<br>Drawing Ø 2.81 - Ø 2.7 mm<br>(reduction 8%; max 39%)<br>(reduction possible)<br>Degreasing<br>Annealing | | |

The cold drawn and annealed wire then was cold-rolled to final cross-section and shape, e.g. to any of the shapes which are shown in FIG. 1A–1.

It should be understood that the conventionally manufactured, cold drawn wire as well as the cold drawn wire which is manufactured according to the invention can be drawn to even thinner sizes than Ø2.7 mm, which sometimes is required and which occurs for certain compression rings. In that case, the limited ductility of the conventional material will be still more accentuated. About ten intermediate annealing operations may be required in order to make it possible to draw a wire down to Ø1.0 mm if the conventional material is used, which drastically increases the production costs. If the material of the invention, which contains a lot of small and evenly distributed carbides, but no large carbides, is used, only a significantly reduced number of intermediate annealing operations are necessary.

The two materials, the conventionally manufactured material and the material manufactured according to the invention, were analyzed with reference to their contents of carbides prior to cold drawing. The samples to be studied were etched by the action of a reagent which made it possible to count and to estimate the sizes of the carbides through light-optical microscopic studies at a magnification of 500×. For each material 210 fields were studied, each field consisting of a square of size 0.020 $mm^2$, i.e. totally 4.2 $mm^2$. Each field was compared with a standard for the estimation of the size type of the largest, existing carbides in each field according to a standard test based on the damaging degree of the carbides with reference to size. Five such levels were employed in the test, namely the maximal carbide sizes 8 μm 10 μm, 17 μm, 24 μm and 38 μm, respectively. The damaging factor, S, of the carbides having these maximal sizes are stated in Table 2, which shows that e.g. carbides having sizes up to max 8 μm have been afforded a damaging factor 0.01, while carbides having sizes up to max 38 μm have the damaging factor 4. By multiplying the number of fields by the respective damaging factor, summing up the products, and dividing the sum by the total studied area, 4,2 $mm^2$, a carbide index, IC, is obtained. As is shown in Table 2, the carbide index, IC, of the conventional material was 21.9, while the index of the material of the invention was only 0.5.

In this connection, it should also be stated that the above is a standard test, in which all carbides having sizes up to max 8 μm have been afforded a damaging factor, S, of 0.01. As a matter of fact no carbides at all, larger then 6 μm in the longest extension of the carbides could be observed in the material of the invention. It should also be stated that in each studied field a lot of such, very small carbides could be observed. Any zones which are particularly carbide rich, or agglomerates of carbides, could not be observed in a material of the invention. All these conditions indicate that the material of the invention has a great presence of very small and evenly distributed carbides, which is desirable from several reasons, such as from ductility—and wear strength point of view.

TABLE 2

| Carbide analyses | | | | | |
|---|---|---|---|---|---|
| | Damaging | Number of fields, F | | S x F | |
| Max carbide size | degree factor. S | Conventional | Invention | Conventional | Invention |
| 8 μm | 0.01 | 66 | 210 | 0.66 | 2.1 |
| 10 μm | 0.5 | 118 | — | 59.0 | — |
| 17 μm | 1 | 24 | — | 24 | — |
| 24 μm | 2 | 2 | — | 4 | — |
| 38 μm | 4 | — | — | — | — |
| | | | ΣS x F | 87.2 | 2.1 |
| Carbide index, IC = $\frac{\Sigma S \times F}{\Sigma area}$ | | | | 21.9 | 0.5 |

When the wire-shaped product has achieved its final shape in cross-section through cold-rolling, the wire is bright hardened and tempered so that the material will get a microstructure consisting of tempered martensite containing evenly distributed carbides having a size amounting to max 8 μm, preferably a size of max 6 μm in the longest extension of the carbide.

What is claimed is:

1. Wire-shaped product with a high wear resistance and a high corrosion resistance, which product is cold drawn and subsequently flattened by cold-rolling, hardened and annealed, the product consisting of a martensitic stainless chromium steel which contains in weight-%:

0.6–3.0 C max 2.0 Si max 2.0 Mn

13–30 Cr

0–10 Mo from zero to max 10% of a strong carbide forming element selected from the group consisting of V, Nb, Ta and Zr, max 1% of other, optionally existing alloying elements, balance iron and unavoidable impurities, wherein the steel has a microstructure substantially consisting of tempered martensite which contains carbides having a maximal carbide size which does not exceed 6 μm obtained through powder metallurgical manufacture of steel, said carbides being evenly distributed in the steel such that in a field consisting of a square of 0.02 $mm^2$ a plurality of such carbides can be observed by a means of a light-optical microscope.

2. Wire-shaped product according to claim 1, wherein the steel contains 0.8–2.0 C 17–25 Cr 0.5–4 Mo max 0.5 V balance essentially only iron and impurities.

3. Wire-shaped product according to claim 2, wherein the steel contains 0.8–1.0 C 0.1–1.0 Si 0.1–1.0 Mn max 0.040 P max 0.030 S 17–19 Cr 0.05–0.2 V 0.5–2.0 Mo balance essentially only iron and impurities.

* * * * *